United States Patent [19]

Viscardi

[11] 4,298,034

[45] Nov. 3, 1981

[54] WEFT PRESENTING DEVICE FOR WEAVING LOOMS

[75] Inventor: Ettore Viscardi, Nembro, Italy

[73] Assignee: Somet Societa Meccanica Tessile S.p.A., Gazzaniga, Italy

[21] Appl. No.: 117,297

[22] Filed: Jan. 31, 1980

[30] Foreign Application Priority Data

Feb. 9, 1979 [IT] Italy ..... 20077 A/79

[51] Int. Cl.[3] ..... D03D 47/38

[52] U.S. Cl. ..... 139/453

[58] Field of Search ..... 139/453, 66, 67, 68, 139/71, 72

[56] References Cited

U.S. PATENT DOCUMENTS 3,352,328 11/1967 Pfarrwaller ..... 139/71

3,548,886 12/1970 Scherillo ..... 139/453

4,191,222 3/1980 Marshall ..... 139/453

*Primary Examiner*—Henry Jaudon

*Attorney, Agent, or Firm*—Stevens, Davis, Miller & Mosher

[57] ABSTRACT

A device for presenting the weft in weaving looms comprising a plurality of oscillating presenting rods having their free end in the form of an eyelet for the weft thread, a corresponding plurality of control levers for the rods, magnet means for causing the oscillation of the control levers under the control of a weft selection device, and a transversal bar for operating the levers being adapted to engage an appropriate seat of those of the levers having been selected by the selection device through the magnet means - the transversal operating bar has a flattened section with mixed-line contour, adapted to freely insert itself into the seat of the control levers of the device, the seat having a corresponding mixed-line contour section, and to respectively cooperate with the seat (like a pin in a hole), depending on the reciprocal position between the transversal bar and the seats of the levers; and the bar is fixed to an end of at least one guide lever which controls the position thereof during its movements and which is pivoted, at its other end, to a connecting rod oscillating about a fixed point.

3 Claims, 5 Drawing Figures

WEFT PRESENTING DEVICE FOR WEAVING LOOMS

BACKGROUND OF THE INVENTION

The present invention relates to important improvements in the devices for presenting the weft to the weft-carrying grippers in weaving looms of the type with continuous weft feed.

The device according to the invention is of the type comprising a plurality of oscillating presenting rods having their free end in the form of an eyelet for the weft thread, a corresponding plurality of control levers for the rods, magnet means for causing the oscillation of said control levers under the control of a weft selection device, and a transversal bar for operating the levers being adapted to engage an appropriate seat of those of the levers having been selected by the selection device through the magnet means.

SUMMARY OF THE INVENTION

In order to limit the slacks and vibrations typical of modern presenting devices of this type and to thus obtain, on one hand, a more precise and safe working and, on the other hand, a considerable reduction in noise, the present invention provides for the operating bar to have a flattened section with mixed-line contour, adapted to freely insert itself into the seat of the control levers of the device—the seat having a corresponding mixed-line contour section—and to respectively cooperate with the seat (like a pin in a hole), depending on the reciprocal position between the bar and the seats; the bar is fixed to an end of at least one guide lever which controls the position thereof during its movements and which is pivoted, at its other end, to a connecting rod oscillating about a fixed point.

BRIEF DESCRIPTION OF THE DRAWINGS

Further characteristics and advantages of the present invention will result evident from the following description of a preferred embodiment of the device, given by way of example with reference to the accompanying drawings, in which.

DESCRIPTION OF THE PREFERRED EMBODIMENTS

Figure 1:
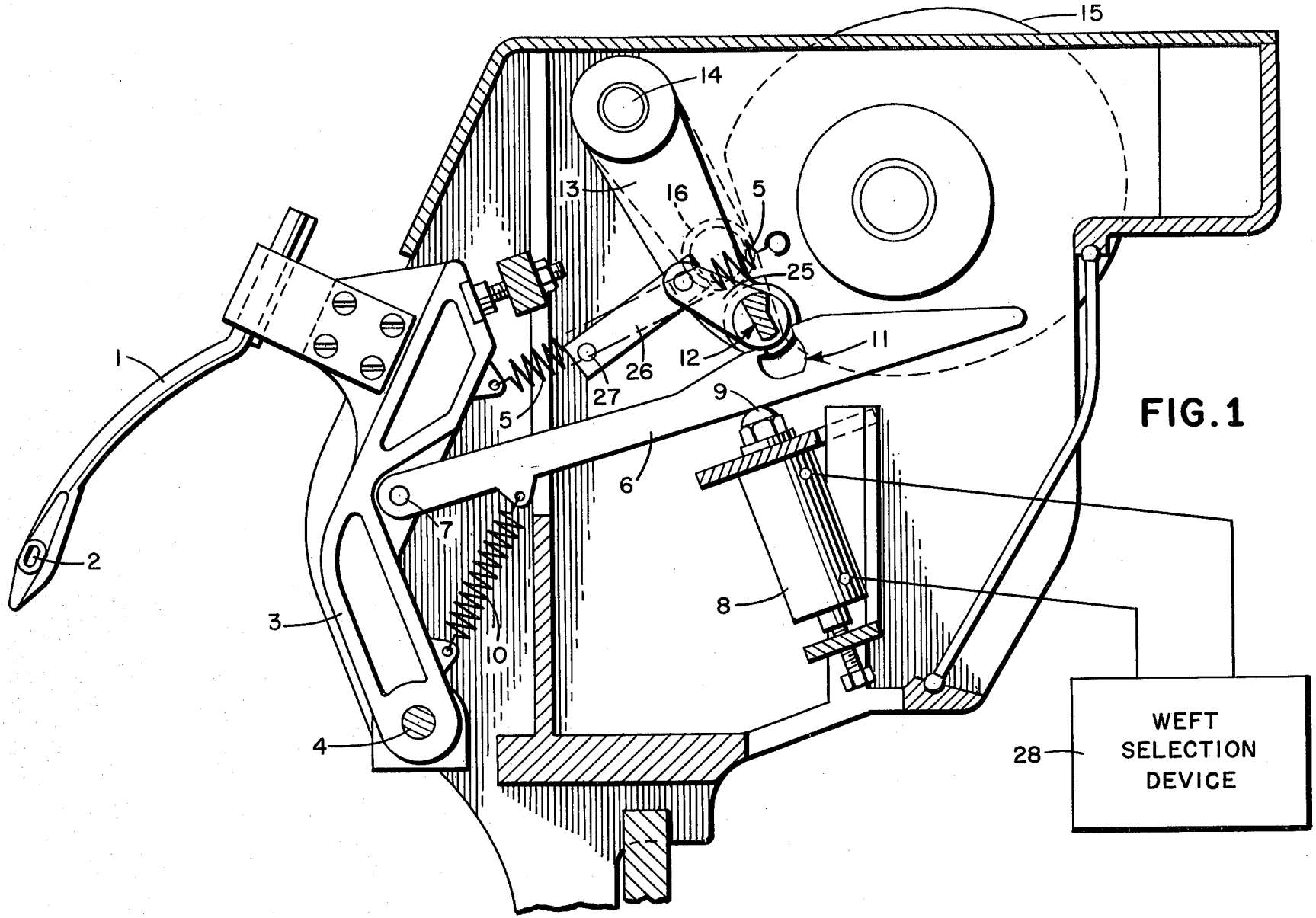
FIG. 1 is a general schematic view of the device according to the invention in one position.

With reference to the drawings, the weft presenting device according to the invention comprises, in a known way, a plurality of arc-shaped presenting rods 1, being provided at their free ends with eyelets 2 for the weft thread and being mounted with the other end fixed to an end of rod-carrying members 3 oscillating about their other end 4. The presenting rods are normally held in a retracted position by springs 5, but they can each be driven into an active or presenting position by a corresponding control lever 6, which is pivoted to an intermediate point 7 of the member 3. The levers 6 bear, close to their end opposite to that pivoted to the members 3, against the cores 9 of electromagnets 8, being pressed against said cores by springs 10. Each of the levers 6 is provided with a seat 11, to be engged by an operating bar 12 arranged transversally to the levers 6.

The transversal bar 12 is idly pivoted at the ends of a pair of levers 13, which are caused to oscillate about 14 by means of a cam control 15 and a cam-follower 16 controlled by the general movement of the loom.

In the known devices, when the weft selection device 28 of the loom starts to work, one or more of the electromagnets 8 are energized and the respective cores 9 push upwardly the corresponding levers 6 which oscillate about the point 7 of the members 3. The seats 11 of such levers 6 are engaged by the bar 12 so that, when this bar 12 is pushed towards the rods 1 by the movement produced by cam 15 to the levers 13, the members 3 and the rods 1 are caused to oscillate from the retracted position to that of presenting the weft which is guided through the eyelets 2 of the oscillating presenting rods.

In the prior art, the engagement between the bar 12 and the seats 11 of the levers 6 always took place with a certain slack: consequently, the movement of the levers 6 could not be guided with the desirable precision, there were vibrations and noise, the possibility arose that the weft thread being presented might occasionally not be grapsed by the weft-carrying gripper, and so on.

Figure 4:
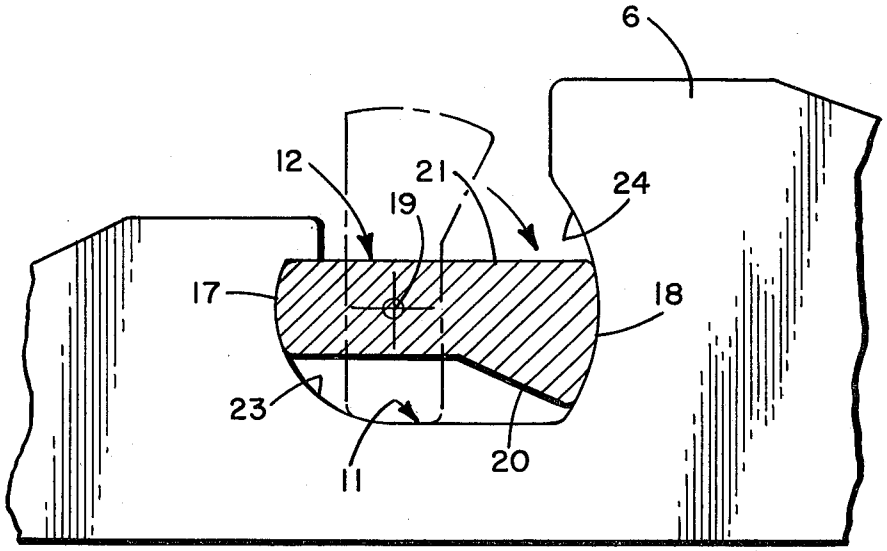
FIG. 4 shows the engagement of the operating bar with the seat of a control lever.
Figure 5:
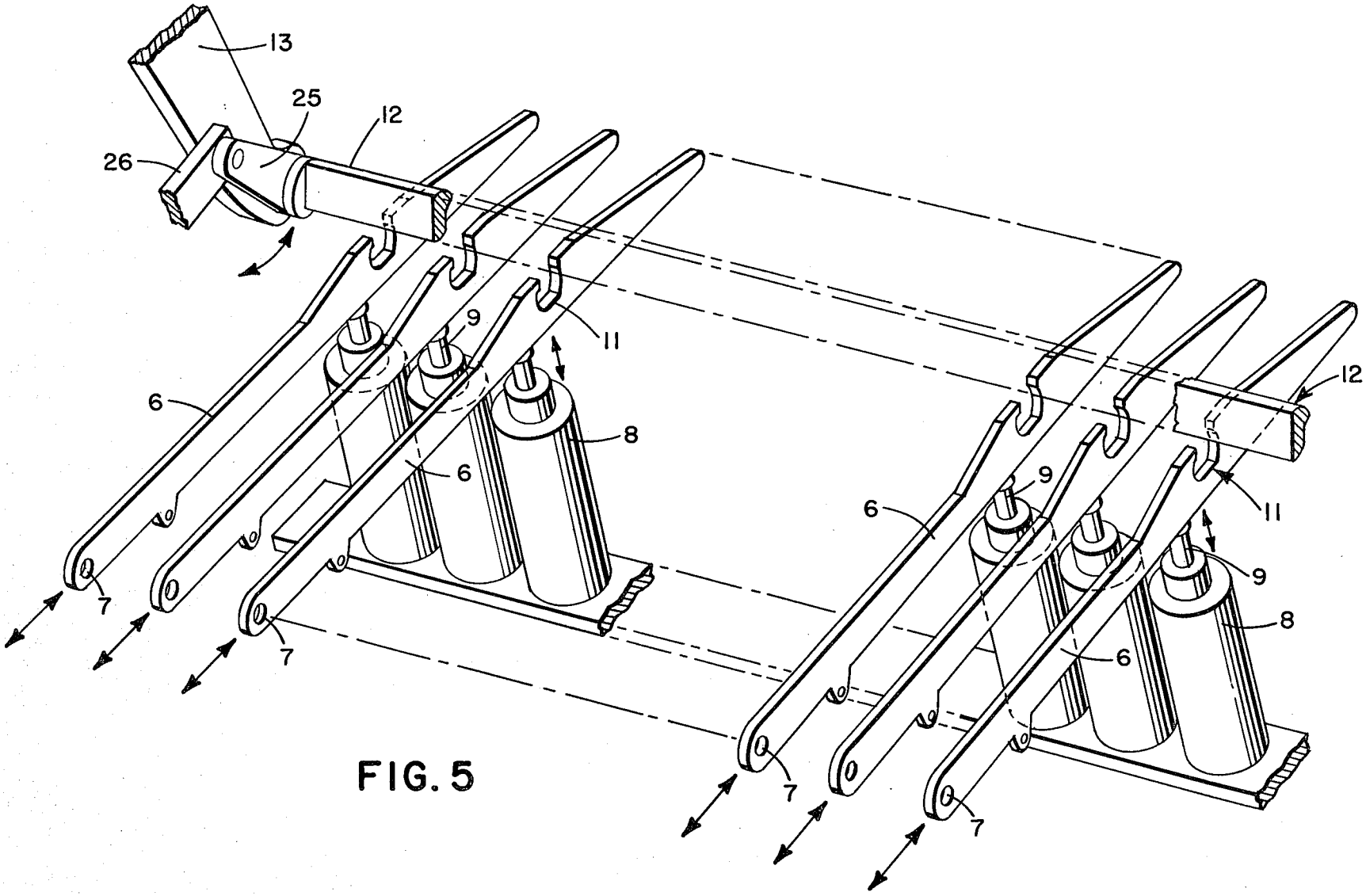
FIG. 5 is a perspective view of the device according to the invention showing a number of control levers.

To avoid all these drawbacks, the present invention provides for a particular type of engagement between the bar 12 and the corresponding seats 11 of the control levers 6, adapted to guarantee, on one hand, an easy and free insertion of the bar in the seats and its equally easy and free outlet therefrom and, on the other hand, a tight reciprocal engagement—practically without slack—between the same components when the bar moves to cause the levers 6, and hence the rods 1, to perform their oscillatory working motion. For this purpose, the bar 12 has a flattened section with mixed-line contour, being delimited (FIG. 4) by two circle arcs 17 and 18 and by straight line segments 20 and 21 which join the ends of the arcs. The circle arcs 17 and 18 have a common center 19 inside the section but a different radius. Correspondingly, the seats 11 of the control levers 6 are formed by two cylindrical surfaces 23 and 24 with a common center, inside the seat, and with different radiuses, substantially equal to those of the arcs delimiting the section of the bar 12. The seats 11 are appropriately radiused. Moreover, the bar 12, as well as being pivoted idly on the levers 13 oscillating about 14, is also fixed to an end of at least one guide lever 25 (two of such levers can be provided, being equal and parallel), which is pivoted with its other end to a connecting rod 26 oscillating about a fixed point 27.

Figure 2:
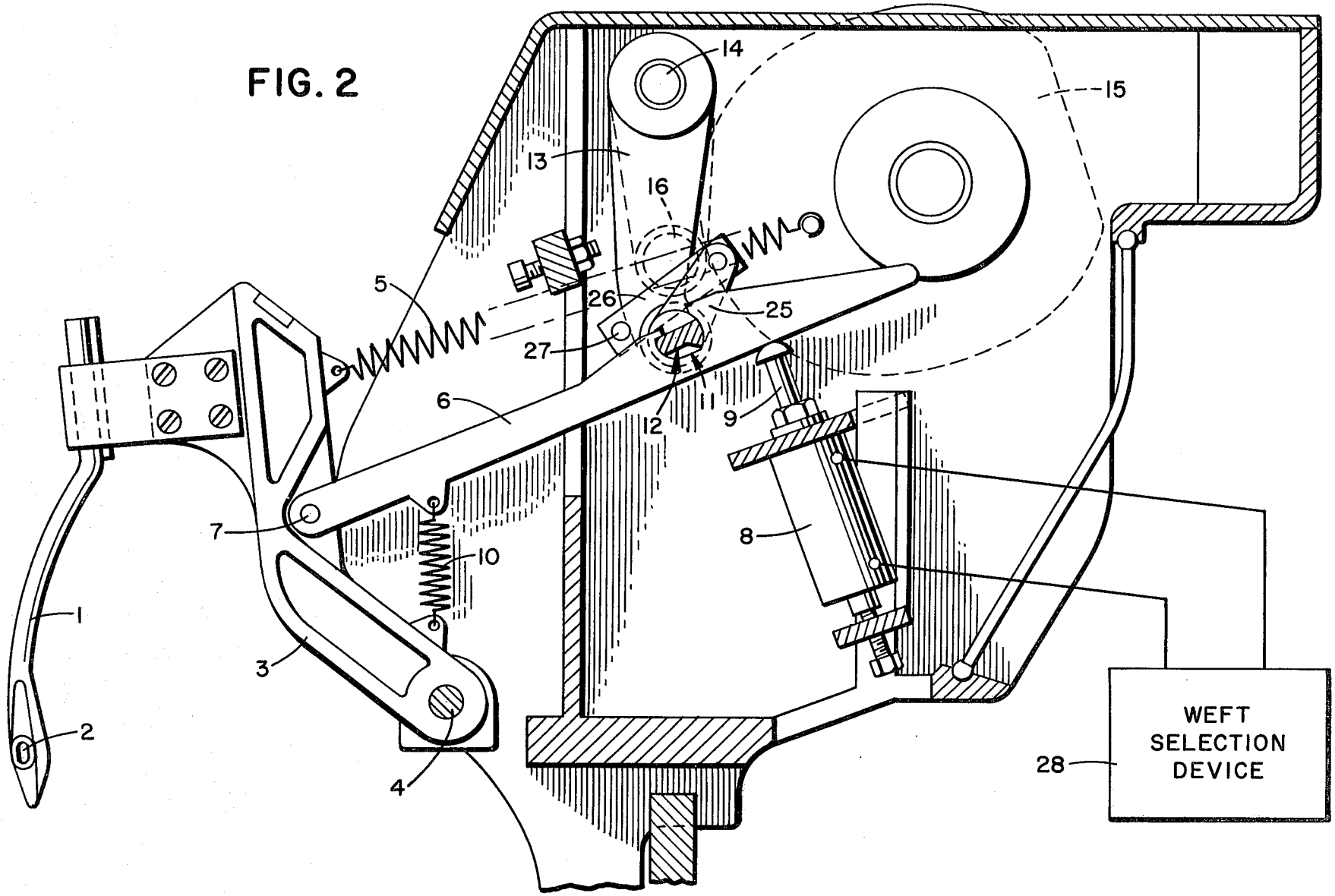
FIG. 2 is a general schematic view of the device according to the invention in another position.
Figure 3:
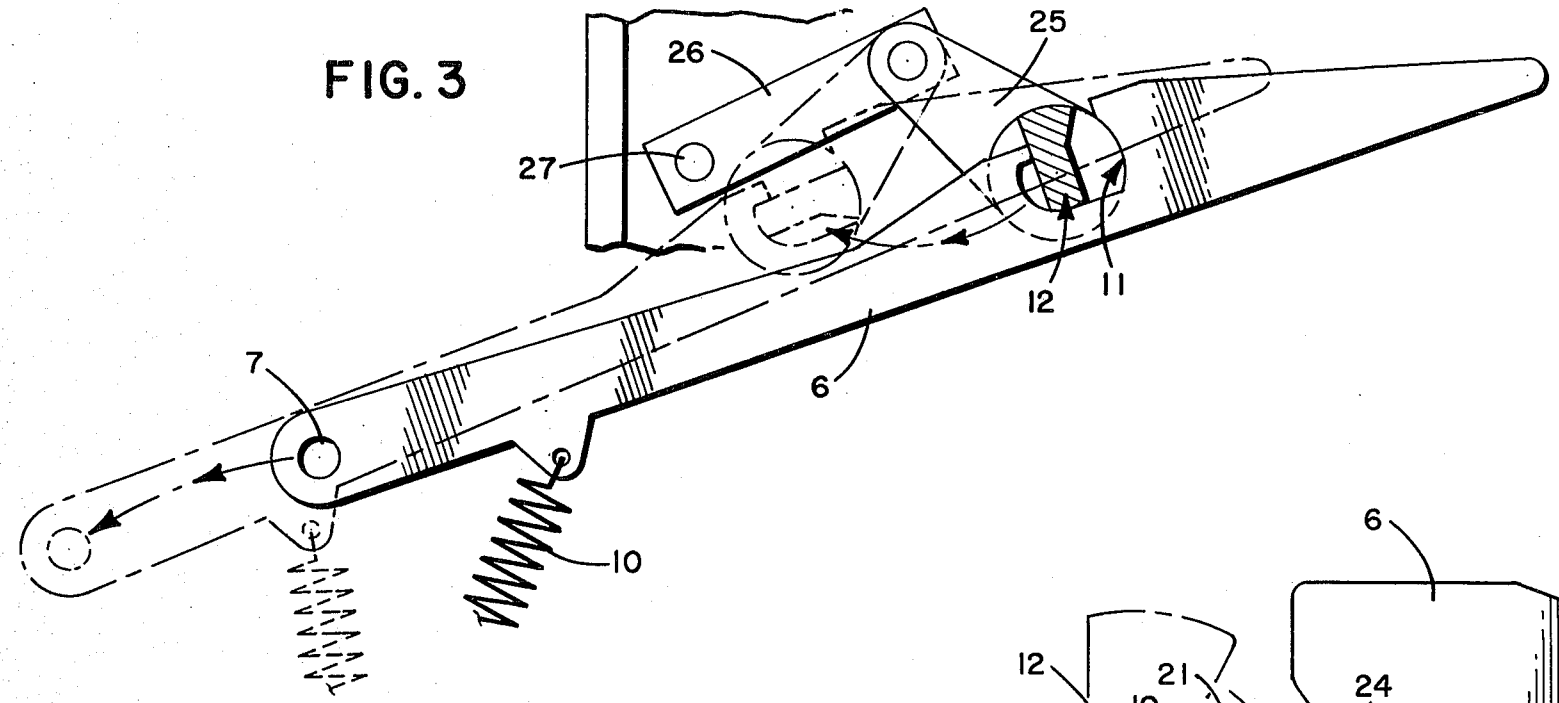
FIG. 3 shows an enlarged detail of a control lever and of the operating bar with its guide lever.

With this arrangement, the flattened bar 12 disposes itself substantially vertical (or sideways) at the moment of its insertion into the seats 11 of the levers 6, or of its outlet therefrom (as shown in FIG. 1 and in dashed lines in FIG. 4), while it rotates tending to rapidly dispose itself horizontally (or flat) as soon as it starts to move forward—under the control of the levers 13—to drive the lvers 6 and the rods 1 towards the working position (as shown in FIG. 2). In this manner, the engagement and disengagement of the bar 12, into and from the seats 11, takes place in an easy and free way because of the presence of remarkable slack (see FIG. 4), but once the insertion has taken place and the motion of the levers 6 has started, the forward and backward control of said levers will then take place by a slackless (and thus noiseless and vibrationless) as well as extremely precise engagement (see FIG. 4, and FIG. 2). In fact, in a horizontal or flat position, the bar 12 engages its own cylindrical surfaces with the corresponding cylindrical surfaces of the seats 11 of levers 6, with extreme precision if working and assembly of the parts are accurate. It is understood that other embodiments of the device according to the invention, or modifications of the one heretofore described, may be possible without thereby departing from the scope of the invention itself.

What is claimed is:

1. A device for presenting the weft in weaving looms, comprising a plurality of oscillating presenting rods having their free end in the form of an eyelet for the weft thread, a corresponding plurality of control levers for said rods, magnet means for causing the oscillation of said control levers and a transversal bar for the operaton thereof; engaging an approximate seat of those control levers being oscillated by said magnet means, characterized in that, the transversal operating bar has a flattened section with mixed-line contour, adapted to freely insert itself into the seat of the control levers of the device, said seat having a corresponding mixed-line contour section, and to respectively cooperate with said seat, depending on the reciprocal position between the transversal bar and the seats of the levers, and in that, said bar is fixed to an end of at least one guide lever which controls the position thereof during its movements and which is pivoted, at its outer end, to a connecting rod oscillating about a fixed point.

2. A weft presenting device as in claim 1, wherein the section of the transversal operating bar is delimited by two circle arcs and by straight line segments joining the ends of said arcs, said circle arcs having a common centre inside said section and a different radius, and wherein the seats of the control levers are formed by two cylindrical surfaces with common centre inside said seats and with different radiuses, substantially equal to the radiuses of the arcs delimiting the section of the bar.

3. A weft presenting device as in claim 1, in which two levers are provided for guiding the position of the bar, each lever being pivoted to a connecting rod oscillating about a fixed point, said guide levers and said connecting rods being respectively alike and parallel to each other.

* * * * *